US007094025B2

(12) United States Patent
Arness et al.

(10) Patent No.: US 7,094,025 B2
(45) Date of Patent: Aug. 22, 2006

(54) APPARATUS AND METHODS FOR REMOVING AND INSTALLING A SELECTED NOZZLE SEGMENT OF A GAS TURBINE IN AN AXIAL DIRECTION

(75) Inventors: Brian Peter Arness, Simpsonville, SC (US); John Ellington Greene, Greenville, SC (US); Linda Jean Farral, Greenville, SC (US); Sze Bun Brian Chan, Greer, SC (US)

(73) Assignee: General Electric Company, Schenectady, NY (US)

( * ) Notice: Subject to any disclaimer, the term of this patent is extended or adjusted under 35 U.S.C. 154(b) by 249 days.

(21) Appl. No.: 10/716,449

(22) Filed: Nov. 20, 2003

(65) Prior Publication Data

US 2005/0111969 A1 May 26, 2005

(51) Int. Cl.
*F04D 29/44* (2006.01)

(52) U.S. Cl. ..... 415/189; 415/191; 415/209.2; 415/209.3

(58) Field of Classification Search ..... 415/189, 415/190, 209.2, 209.3, 209.4, 191; 29/889.1, 29/889.22

See application file for complete search history.

(56) References Cited

U.S. PATENT DOCUMENTS

| | | | | | |
|---|---|---|---|---|---|
| 3,423,071 | A | * | 1/1969 | Noren | 415/189 |
| 4,274,805 | A | * | 6/1981 | Holmes | 415/138 |
| 4,815,933 | A | * | 3/1989 | Hansel et al. | 415/189 |
| 4,883,405 | A | * | 11/1989 | Walker | 415/189 |
| 5,141,394 | A | | 8/1992 | Donlan | |
| 5,211,536 | A | * | 5/1993 | Ackerman et al. | 415/209.3 |
| 5,224,822 | A | * | 7/1993 | Lenahan et al. | 415/189 |
| 5,459,995 | A | * | 10/1995 | Norton et al. | 60/796 |
| 5,591,003 | A | * | 1/1997 | Boyd et al. | 415/209.2 |
| 5,618,161 | A | * | 4/1997 | Papageorgiou et al. | 415/190 |

* cited by examiner

*Primary Examiner*—Edward K. Look
*Assistant Examiner*—Igor Kershteyn
(74) *Attorney, Agent, or Firm*—Nixon & Vanderhye P.C.

(57) ABSTRACT

Nozzle segments are secured to a retention ring against circumferential rotation by anti-rotation pins extending generally axially between the outer bands of the nozzle segments and the retention ring. Retention plate segments overlie the ends of the pins, preventing axial removal thereof. To remove a selected nozzle segment, inner diameter retention plate segments and selected retention plate segments are removed, the latter exposing the ends of the pins for axial withdrawal. Upon removal of a predetermined number of pins, the nozzle segments adjacent the selected segment are displaced away from the latter segment to open a gap between the selected segment and adjacent segments whereby the selected segment can be removed in an axial direction.

15 Claims, 6 Drawing Sheets

APPARATUS AND METHODS FOR REMOVING AND INSTALLING A SELECTED NOZZLE SEGMENT OF A GAS TURBINE IN AN AXIAL DIRECTION

BACKGROUND OF THE INVENTION

The present invention relates to apparatus and methods for removing and installing a selected nozzle segment relative to a nozzle retention ring of a gas turbine and particularly relates to axially oriented anti-rotation pins for preventing circumferential movement of the nozzle segments and enabling removal and insertion of the anti-rotation pins in an axial direction to facilitate removal and installation of a selected nozzle segment without removal of the casing.

In gas turbines, the nozzle stages are typically formed by an annular array of nozzle segments spaced circumferentially one from the other about the axis of the turbine. For example, in the first stage of the turbine, the nozzle segments, each including outer and inner bands with one or more nozzle vanes extending therebetween, are secured to annular outer and inner retention rings, respectively. In prior gas turbines, anti-rotation pins typically extend radially between the outer retention ring and an outwardly projecting flange on the outer band of each segment. These radially oriented prior anti-rotation pins encounter space limitations which prevent removal of certain of the pins when performing turbine maintenance in situ. For example, at the horizontal joint, the case is very close to the retention ring and the anti-rotation pin cannot be removed, leaving the nozzle segments essentially non-removable. As a consequence, maintenance and testing operations have been found to be laborious and costly. Therefore, there is a need to generally improve the capability for removing and installing nozzle segments to facilitate maintenance and testing operations.

BRIEF DESCRIPTION OF THE INVENTION

According to a preferred aspect of the present invention, the outer band of each nozzle segment is provided with an axially extending hole for receiving an anti-rotation pin which can be readily removed and replaced, enabling removal and replacement of selected nozzle segments in an axial direction and without the need to remove the case. Each axially extending anti-rotation pin extends through radially outwardly extending slots in radial outward flanges of the outer band of the corresponding nozzle segment and through corresponding holes in the retainer ring. Retainer plate segments overlie the end axial faces of the anti-rotation pins and are secured to the retainer ring. By removing the retention plate segments, the anti-rotation pins can be removed in an axial forward direction, enabling circumferential removal and insertion of each of the nozzle segments.

It will be appreciated that the nozzle segments have gaps between respective inner and outer bands of circumferentially adjacent segments and which gaps are provided with seals, for example, spline seals. These spline seals, as well as the shape of the nozzle segments, prevent direct axial removal of the nozzle segments upon removal of the anti-rotation pins. In accordance with a preferred aspect of the present invention, the nozzle segments are enabled for removal in an axial direction. Particularly, the anti-rotation pins of the selected segment and nozzle segments adjacent the selected segment are removed in an axial direction and the adjacent segments are stacked in a circumferential direction away from the selected nozzle segment. In this manner, the gap distances between adjacent segments are eliminated and an enlarged gap is opened between the selected segment and an adjacent segment, enabling axial removal of the selected segment. The anti-rotation pins and retention plate segments are removable without removing the case. To replace the segment the foregoing procedure is reversed.

In a preferred embodiment according to the present invention, there is provided a retention system for nozzles of a turbine, comprising a nozzle retention ring for disposition about an axis of the turbine, a plurality of circumferentially adjacent nozzle segments carried by the nozzle retention ring and anti-rotation pins extending in generally axial directions and engaging between the retention ring and the nozzle segments, respectively, to restrain movement of the nozzle segments in a rotational direction about the turbine axis.

In a further preferred embodiment according to the present invention, there is provided a method of removing in an axial direction a selected nozzle segment of an annular array of nozzle segments forming a stage of a turbine from a retention ring carrying the annular array of nozzle segments, comprising the steps of (a) removing in a generally axial direction substantially axially extending pins from a plurality of nozzle segments of the annular array thereof, including the selected nozzle segment, and the retention ring, thereby releasing nozzle segments adjacent the selected nozzle segment for sliding movement about an axis of the turbine in a circumferential direction away from the selected nozzle segment, (b) sliding the released nozzle segments adjacent the selected nozzle segment in a circumferential direction about the axis away from the selected nozzle segment and (c) removing the selected nozzle segment in a generally axial direction.

In a further preferred embodiment according to the present invention, there is provided a method of installing a selected nozzle segment into an opening in an annular array of nozzle segments for forming a stage of a turbine, comprising the steps of (a) inserting the selected nozzle segment in a generally axial direction into the opening, (b) inserting a pin in an axial direction through the selected nozzle segment and the retention ring to secure the selected nozzle segment to the nozzle retention ring, (c) sliding nozzle segments adjacent the inserted selected nozzle segment in a circumferential direction toward the selected nozzle segment into predetermined circumferential positions about the turbine axis and (d) securing the adjacent nozzle segments to the retention ring in the predetermined circumferential positions.

DETAILED DESCRIPTION OF THE INVENTION

Figure 1:
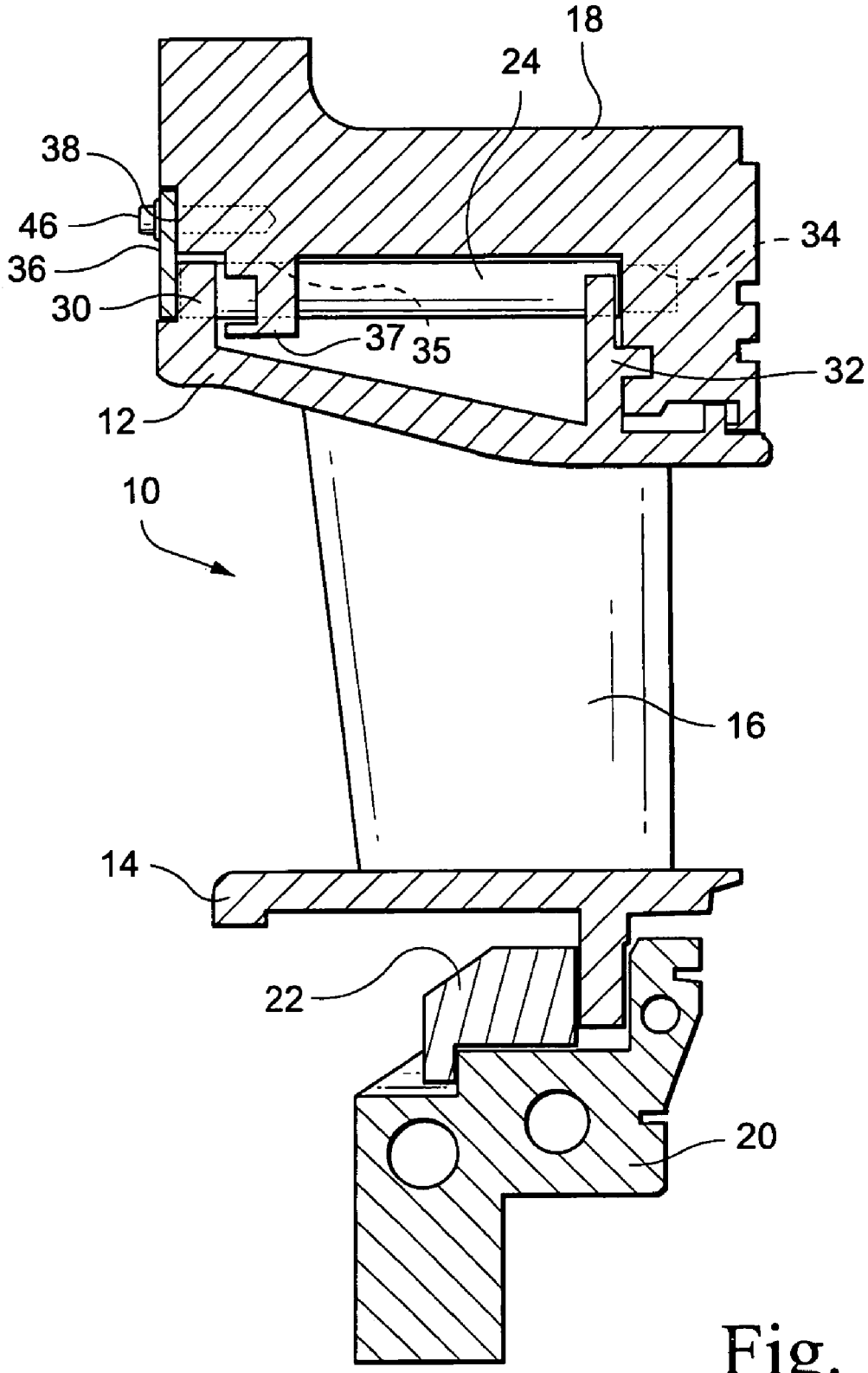
FIG. 1 is a cross-sectional view of a nozzle segment for use in a stage of a gas turbine.

Referring to FIG. 1, there is illustrated a nozzle segment, generally designated 10, and including an outer band 12, an inner band 14 and one or more nozzle vanes 16 extending between the outer and inner bands. The outer bands 12 of the nozzle segments 10 are secured to an outer retention ring 18. The inner bands 14 are secured to an inner casing 20, by an annular array of inner diameter retention plates 22. The retention plates 22 are bolted to the casing 20 with bolts, not shown, extending in an axial direction, enabling removal of the inner diameter retention plates 22 in an axial forward direction.

In accordance with a preferred aspect of the present invention, axially extending anti-rotation pins 24 are provided between the outer bands 12 and the outer retention ring 18, preferably one pin 24 per segment 10. Particularly, the outer band 12 includes a pair of radially outwardly extending flanges 30 and 32, respectively, axially spaced one from the other. Axially aligned slots are provided in the flanges and receive the anti-rotation pin 24. The retention ring 18 includes an aperture 34 along an aft portion which receives one end of the anti-rotation pin 24. The opposite end of the anti-rotation pin passes through an opening 35 in a flange 37 along a forward portion of ring 18 and engages in the slot of the forward flange 30 of the outer band 12. With the anti-rotation pin 24 in place, it will be appreciated that the nozzle segment 10 is secured against rotation about the turbine axis.

Figure 4:
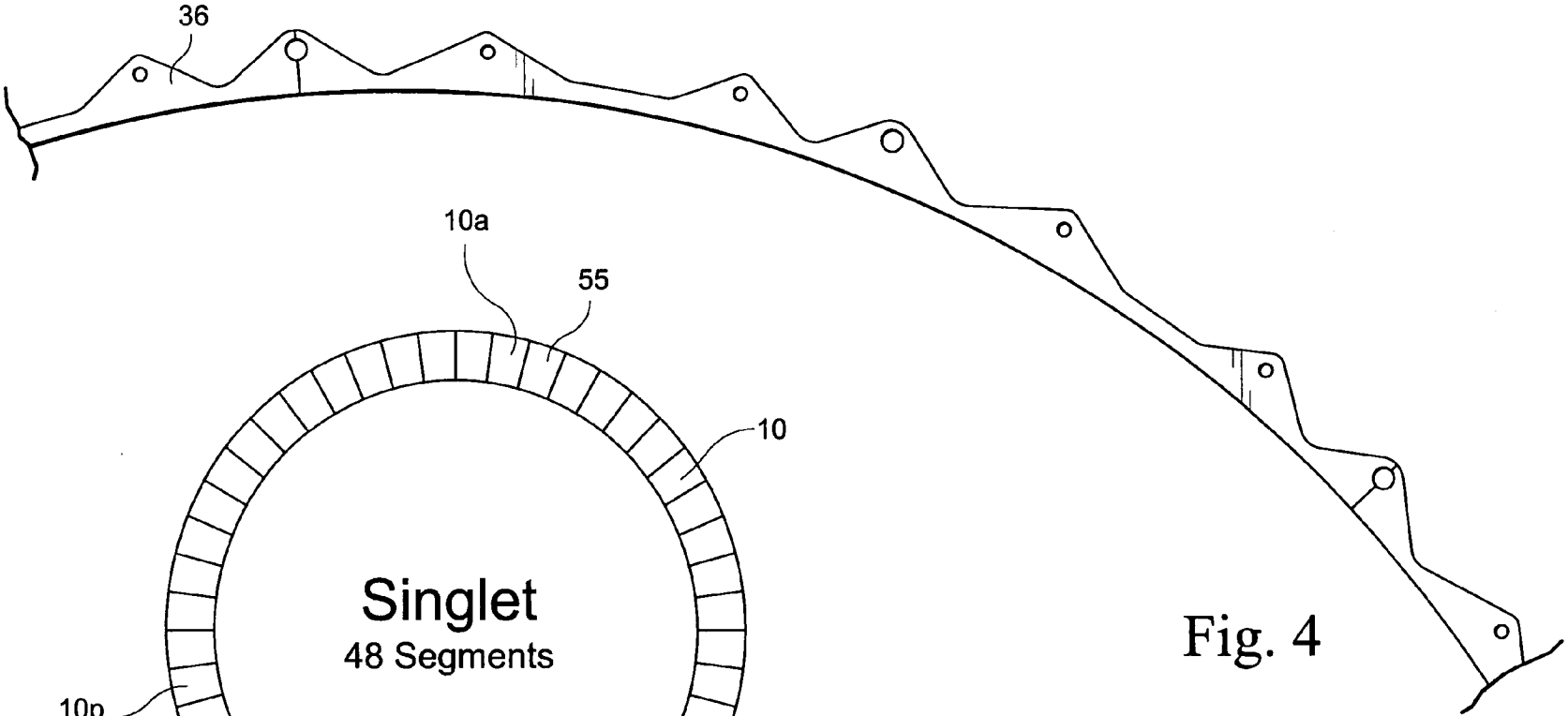
FIG. 4 is an axial end view of the retention plate segments.

To retain the anti-rotation pins 24 in positions preventing rotation of the nozzle segments 10 relative to the retention ring 18, an annular array of a plurality of retention plate segments 36 are secured to and on the forward face of the retention ring 18. Particularly, an annular groove or surface 38 is formed in the forward face 40 of the retention ring 18 and bolt holes 42 are provided in the retention ring 18 opening through the forward face of the groove 38. As illustrated in FIG. 4, the retention plate segments 36 have shaped portions corresponding to the shape of the grooves 38. Bolt holes 44 are provided in the segments 36. Consequently, the annular array of segments 36 may be bolted in the groove 38 along the forward face of the retention ring 18 to overlie the anti-rotation pins 24 and thereby maintain the anti-rotation pins 24 in position. The anti-rotation pins 24 prevent circumferential movement of the nozzle segments relative to the retention ring 18. It will be appreciated that by removing the retention plate segments 36, i.e., by removing the bolts 46 securing the segments 36 to the retention ring 18, the ends of the anti-rotation pins 24 are exposed for removal in a forward axial direction. The retention plate segments 36 are preferably provided in lieu of an annular retention plate to enable removal of one or more selected nozzles without removal of the entirety of the segments 36 as described below. Seven retention plate segments 36 are preferred, although it will be appreciated that a fewer or greater number of segments 36 may be provided.

Figure 5:
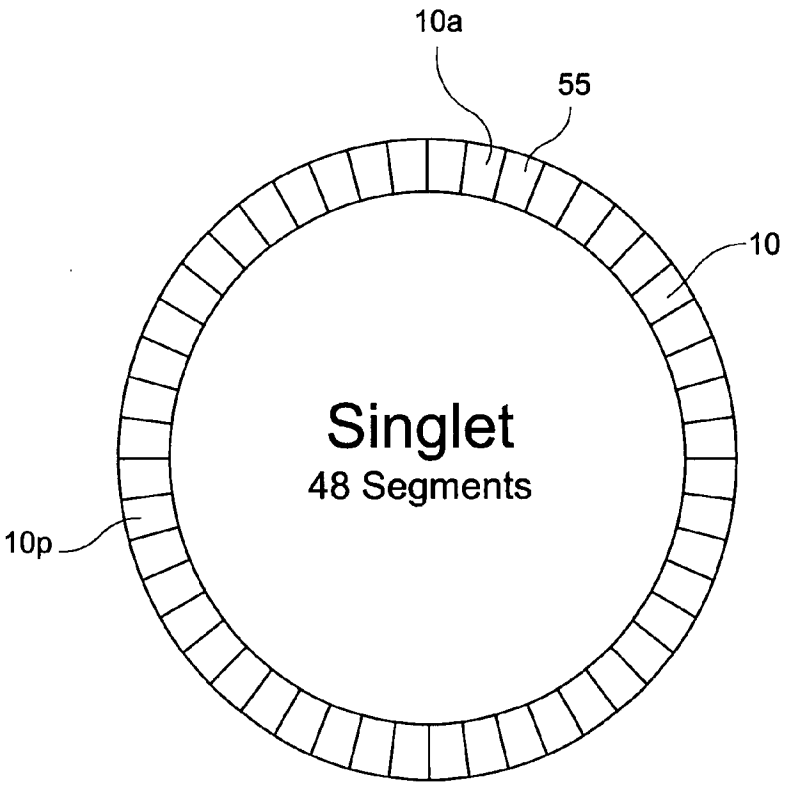
FIG. 5 is an axial schematic view of nozzle segments arranged in an annular array forming a turbine stage.

In order to remove a selected nozzle segment 55 (FIG. 5) from the annular array of nozzle segments 10 and remove the selected segment 55 in an axial direction without removal of the surrounding turbine casing, one or more of the nozzle retention plate segments 36, including the segment 36 overlying the selected nozzle 55, are removed. For example, and for illustrative purposes, there is illustrated in FIG. 5 an annular array of forty-eight nozzle segments 10. In order to remove a selected segment 55, the retention plate segments 36, which overlie the selected segment 55 and fifteen nozzle segments 10*a*–10*p* to one side or the other of the selected nozzle segment 55 are removed, thereby exposing the axially forward facing ends of pins 24. The inner diameter retention segments 22 of the adjacent nozzle segments are also removed from the inner case to release the inner band portions 14 of the nozzle segments 10.

Figure 2:
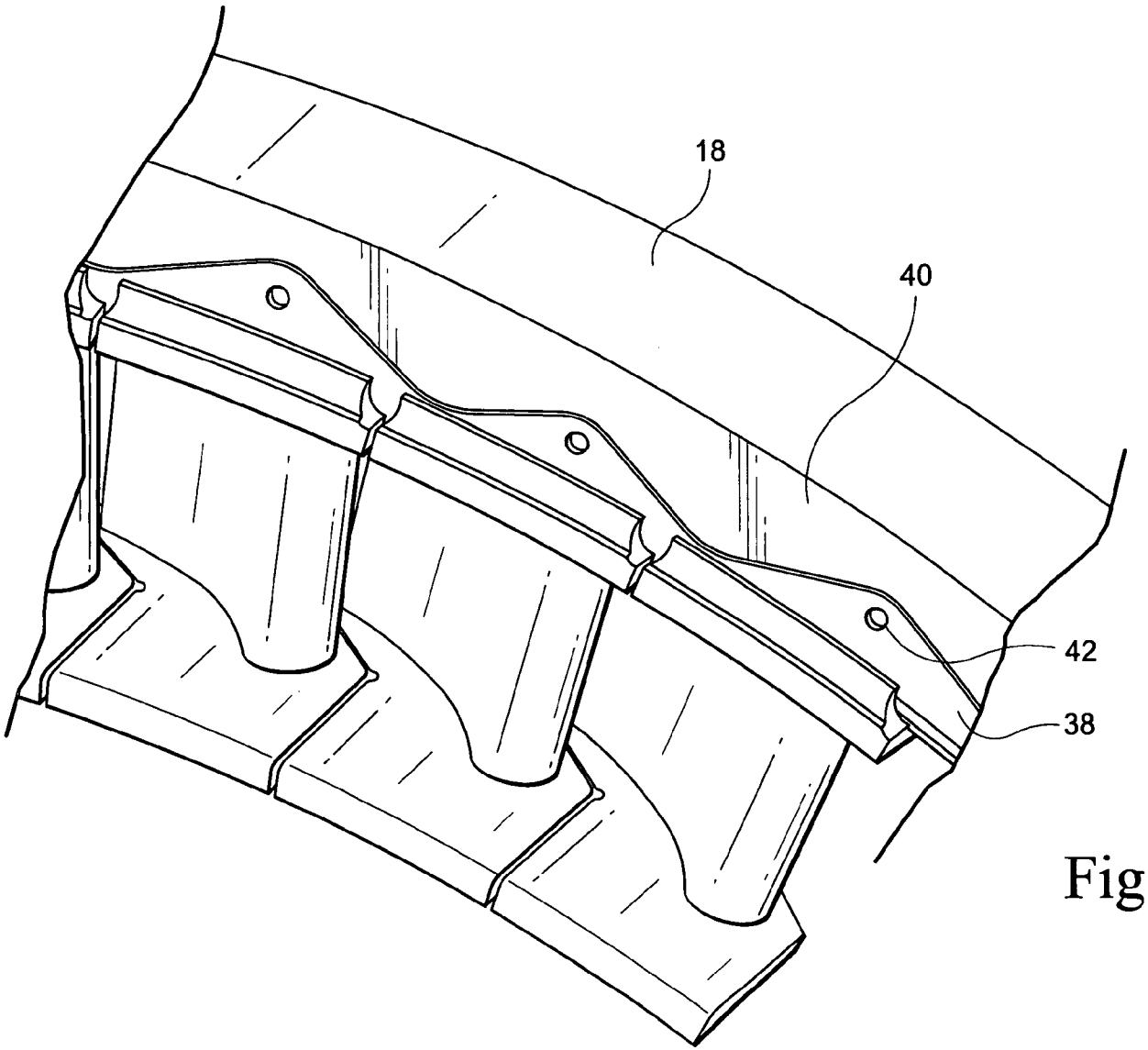
FIG. 2 is a fragmentary perspective view of the nozzle segments and retention ring.
Figure 3:
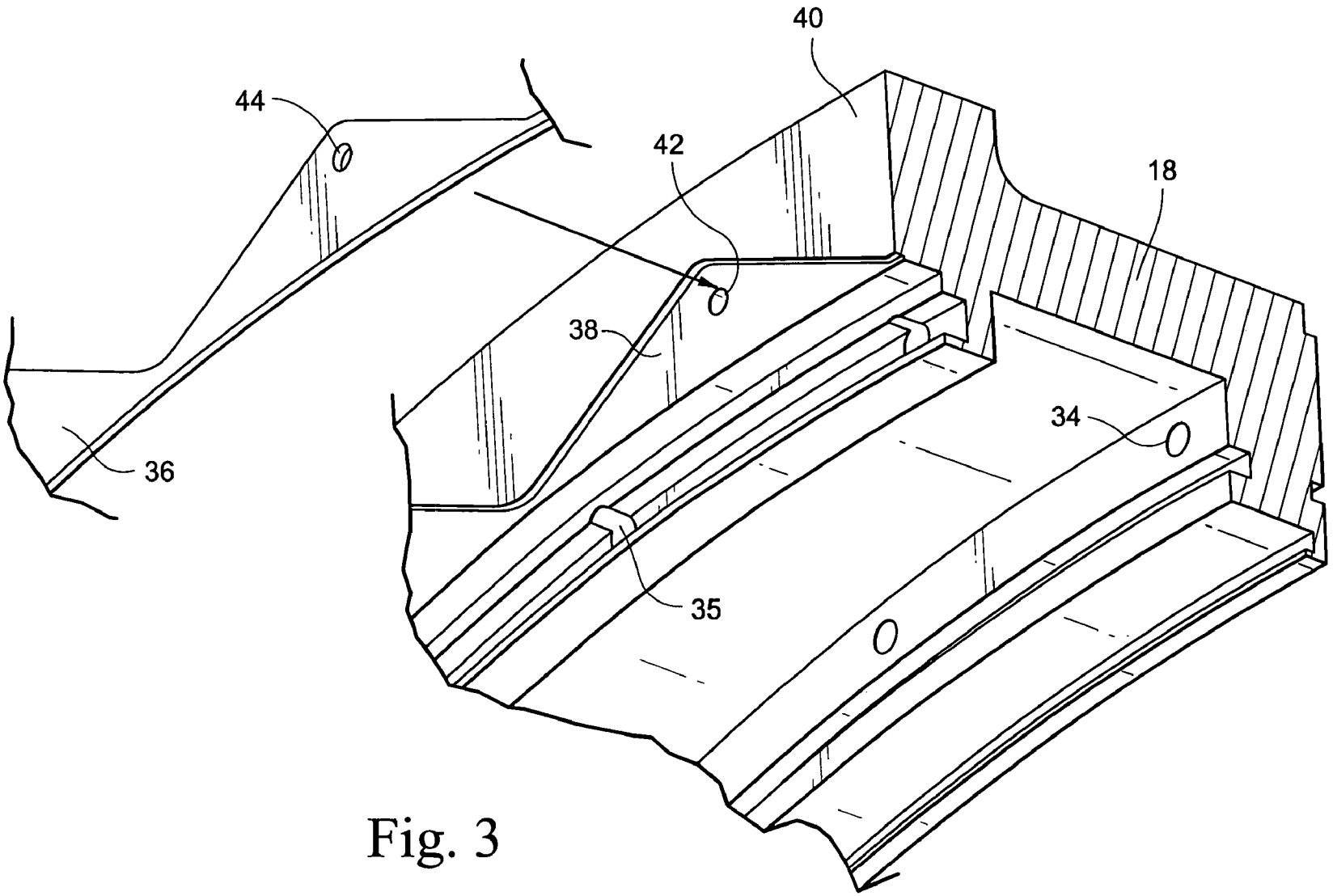
FIG. 3 is a fragmentary perspective view with parts in cross-section of the nozzle retention ring and portions of the retention plate.
Figure 6:
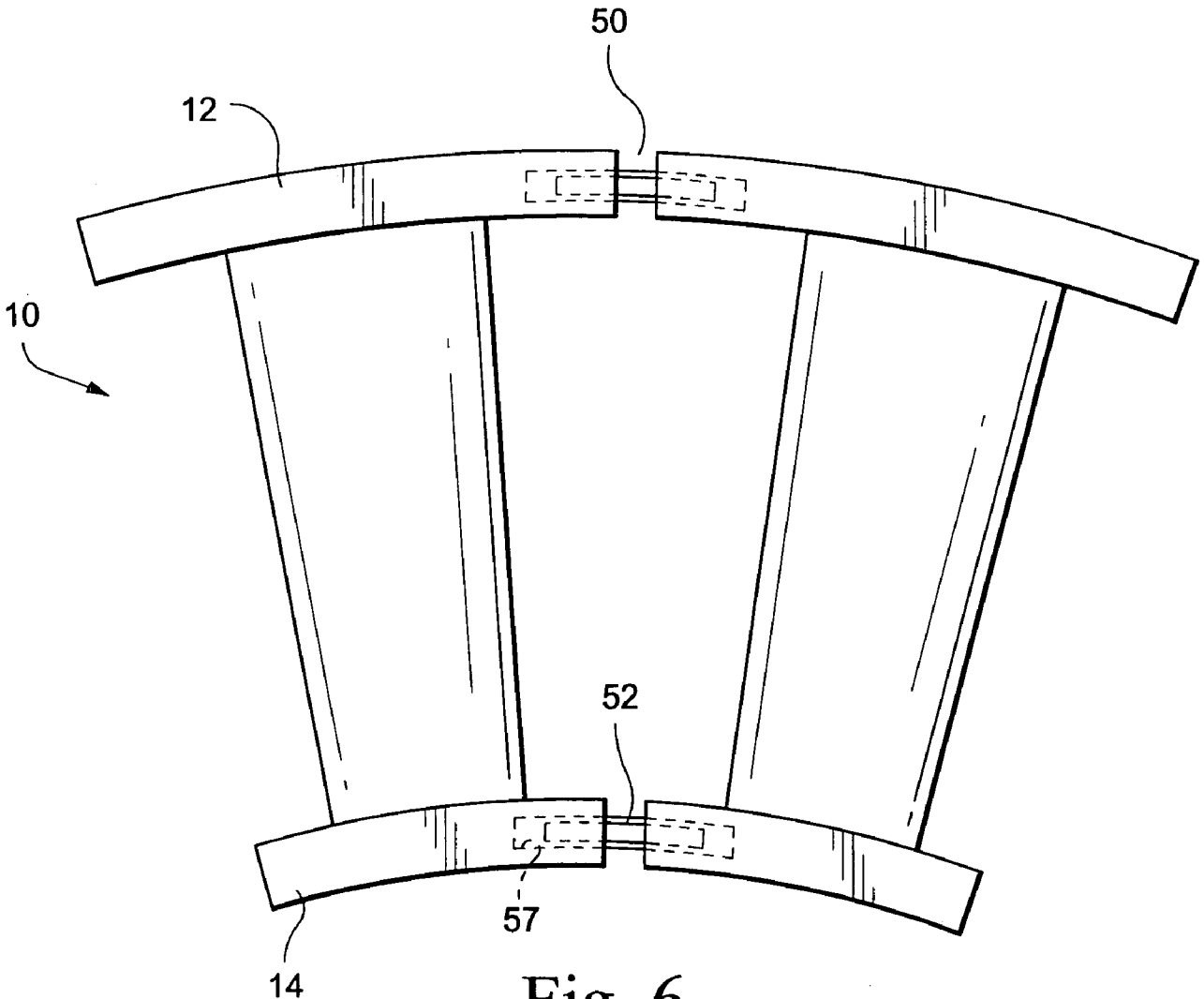
FIG. 6 is a schematic axial view of a pair of adjacent segments illustrating the gaps and spline seals between adjacent segments.

As illustrated in FIG. 6, the adjacent nozzle segments 10 have predetermined gaps 50 between adjacent outer bands 12 and adjacent inner bands 14 which gaps 50 are sealed by spline seals 52. The spline seals, as well as the shape of the segments including the outer and inner bands, as illustrated in FIG. 2, preclude removal of the selected nozzle segment 55 in an axial direction. However, by removing the retention plate segments 36 of about fifteen adjacent nozzle segments 10, as well as removing the anti-rotation pins 24 of each of the adjacent segments 10*a*–10*p* including the selected segment 55, the nozzle segments 10 are released for circumferential rotation. The nozzle segments 10*a*–10*p* adjacent to the selected segment 55 are then circumferentially displaced in a circumferential direction away from the selected segment 55 to stack one against the other, thus reducing or eliminating the gaps 50 between the respective adjacent nozzle segments of the nozzle segments 10*a*–10*p*. It will be appreciated that the spline seals 52 are disposed in slots 57 of the outer and inner bands with excess circumferential space between their circumferential edges and the interior ends of the slots 57. This enables the nozzle segments 10*a*–10*p* to stack circumferentially one against the other once the anti-rotation pins 24 have been withdrawn.

Figure 7:
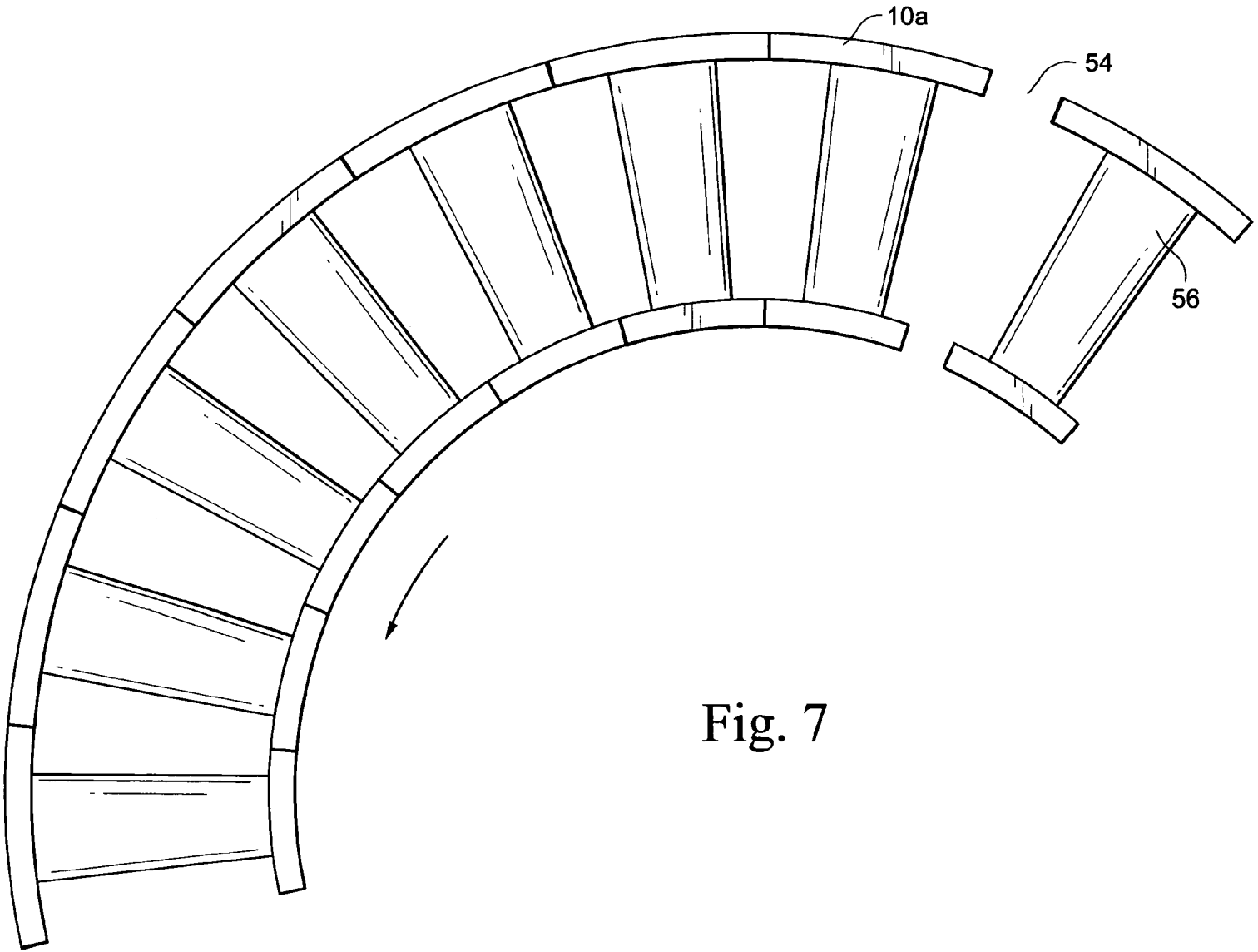
FIG. 7 is an enlarged fragmentary axial end view of the annular segments stacked one against the other, opening a gap between a selected segment and an adjacent segment, enabling axial removal and insertion of the selected segment.

With the appropriate number of nozzle segments 10, e.g., segments 10*a*–10*p*, stacked one against the other away from the selected segment 55, a gap 54 (FIG. 7), at least equal in circumferential extent to the gaps 50 between the released and circumferentially moved nozzle segments 10*a*–10*p* is opened between the selected segment 55 and the adjacent segment 10*a*. The gap 54 is sufficient to permit the spline seals 52 to be removed and the selected nozzle segment 55 displaced axially for removal. Any one or more of the circumferentially displaced nozzle segments 10*a*–10*p* can likewise be removed by displacement of the segments in a circumferential direction toward the opening left by the removed segment 55 to open a gap sufficient to enable removal of a further selected nozzle segment. As a specific example, the typical gap between adjacent segments is 0.003–0.0060 of an inch. The spline seals 52 are about ¾-inch wide. Hence, the stacking of the adjacent segments 10*a*–10*p* against one another in a direction away from the selected segment 55 enlarges the gap between the selected segment 55 and the next-adjacent segment 10*a* to the cumulative extent of the gaps which are closed between adjacent segments.

Once the selected nozzle segment 55 or segments have been refurbished or repaired, or new segments are provided, the procedure can be reversed. For example, the refurbished or new nozzle segment can be inserted axially to bear against the retention ring 18 and the inner casing 20. The anti-rotation pin 24 is then inserted through the aligned holes 30 and 32 of the retention ring 18 and the slots in the outer flanges 30 and 32 of the outer band of the axially inserted segment. The adjacent segments 10*a*–10*p* can then be sequentially displaced circumferentially toward the inserted segment to align the holes 34, 35 and slots of flanges 30, 32 at each circumferential nozzle segment location. The anti-rotation pins 24 are then inserted into the aligned holes and slots of the circumferentially displaced nozzle segments 10*a*–10*p*, thereby fixing their circumferential position. The inner diameter retention plates 22 are also secured to the casing 20, securing the inner bands 14 to the casing 20. The retention plate segments 36 are bolted to the axial face of the retention ring 18 to overlie the forwardly facing ends of the anti-rotation pins 24. The retention plate segments 36 thus maintain those pins in position, securing the nozzle segments 10 against rotation.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A retention system for nozzles of a turbine, comprising:

a nozzle retention ring for disposition about an axis of the turbine;

a plurality of circumferentially adjacent nozzle segments carried by said nozzle retention ring;

anti rotation pins extending in generally axial directions and engaging between said retention ring and said nozzle segments, respectively, to restrain movement of the nozzle segments in a rotational direction about the turbine axis;

wherein said retention ring includes an axially facing surface, said anti rotation pins being exposed through said surface and at least one retention plate segment overlying the axially facing surface, precluding removal of the pins in an axially direction; and wherein each of said nozzle segments includes an outer band and a pair of axially spaced apertures, said retention ring having aligned openings whereby each said pin is received in said apertures and said openings.

2. A system according to claim 1 wherein said retention plate segment comprises one of a plurality of arcuate retention plate segments arranged in an annular array thereof about the axis.

3. A retention system for nozzles of a turbine, comprising:

a nozzle retention ring for disposition about an axis of the turbine;

a plurality of circumferentially adjacent nozzle segments carried by said nozzle retention ring;

anti rotation pins extending in generally axial directions and engaging between said retention ring and said nozzle segments, respectively, to restrain movement of the nozzle segments in a rotational direction about the turbine axis;

wherein said retention ring includes an axially facing surface, said anti rotation pins being exposed through said surface and at least one retention plate segment overlying the axially facing surface, precluding removal of the pins in an axially direction; and wherein said retention plate segment comprises one of a plurality of arcuate retention plate segments arranged in an annular array thereof about the axis, said arcuate retention plates being bolted to said retention ring.

4. A method of removing in an axial direction a selected nozzle segment of an annular array of nozzle segments forming a stage of a turbine from a retention ring carrying the annular array of nozzle segments, comprising the steps of:

(a) removing in a generally axial direction substantially axially extending pins from a plurality of nozzle segments of the annular array thereof, including the selected nozzle segment, and said retention ring, thereby releasing nozzle segments adjacent said selected nozzle segment for sliding movement about an axis of the turbine in a circumferential direction away from the selected nozzle segment;

(b) sliding the released nozzle segments adjacent said selected nozzle segment in a circumferential direction about the axis away from the selected nozzle segment; and (c) removing the selected nozzle segment in a generally axial direction.

5. A method according to claim 4 wherein said nozzle segments are spaced from one another about the axis to define gaps between adjacent nozzles and step (b) includes sliding said adjacent nozzle segments in the circumferential direction away from the selected nozzle segment to stack the adjacent nozzle segments one against the other and thereby open a gap between said adjacent nozzle segments and said selected nozzle segment enabling removal of said selected nozzle segment in said generally axial direction.

6. A method according to claim 4 wherein said nozzle segments are spaced from one another about the axis to define gaps between adjacent nozzles and step (b) includes stacking said adjacent nozzle segments one against the other in the circumferential direction away from the selected nozzle segment to close the gaps between said adjacent segments and open a gap between the selected nozzle segment and said adjacent nozzle segments of sufficient circumferential extent to enable removal of the selected nozzle segment in the generally axial direction.

7. A method according to claim 4 including removing at least one inner diameter retention plate from an inner casing to release an inner band of said selected nozzle segment to enable removal of the selected nozzle segment in the generally axial direction.

8. A method according to claim 4 including securing retention plate segments to said retention ring to overlie said pins and prevent removal of said pins in said substantially axially extending direction.

9. A method according to claim 4 including, prior to step (a), removing at least one retention plate segment overlying said anti rotation pins to enable the pins for removal in said substantially axial direction.

10. A method of installing a selected nozzle segment into an opening in an annular array of nozzle segments for forming a stage of a turbine, comprising the steps of:

(a) inserting the selected nozzle segment in a generally axial direction into said opening;

(b) inserting a pin in an axial direction through the selected nozzle segment and the retention ring to secure the selected nozzle segment to the nozzle retention ring;

(c) sliding nozzle segments adjacent the inserted selected nozzle segment in a circumferential direction toward said selected nozzle segment into predetermined circumferential positions about the turbine axis; and (d) securing said adjacent nozzle segments to said retention ring in said predetermined circumferential positions.

11. A method according to claim 10 wherein step (d) includes inserting pins in an axial direction through said adjacent nozzle segments and the nozzle retention ring to secure the adjacent nozzle segments to said nozzle retention ring.

12. A method according to claim 10 including, prior to step (a), releasing the adjacent nozzle segments from the nozzle retention ring for sliding movement about the axis of the turbine in the circumferential direction and sliding the adjacent nozzle segments in a circumferential direction about the axis to provide said opening in the annular array of said nozzle segments.

13. A method according to claim 10 and, subsequent to step (d), securing a plurality of inner diameter retention plates to a casing of the turbine to retain inner diameter band portions of the nozzle segments in the turbine.

14. A method according to claim 10 including, subsequent to step (d), securing at least one retention plate segment to said retention ring overlying an axially facing end of said pin.

15. A method according to claim 14 including inserting pins in a generally axial direction through said adjacent nozzle segments and said retention ring to secure the adjacent nozzle segments to said retention ring, and securing at least one retention plate segment to said retention ring in overlying relation to an axial end face of said pins to retain said pins in positions securing the adjacent nozzle segments and retention ring to one another.

* * * * *